US011598128B2

(12) United States Patent
Murata

(10) Patent No.: US 11,598,128 B2
(45) Date of Patent: Mar. 7, 2023

(54) FLUSH HANDLE DEVICE FOR CONTROLLING VEHICLE DOOR LATCH

(71) Applicant: Toyota Jidosha Kabushiki Kaisha, Toyota (JP)

(72) Inventor: Kazuki Murata, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 466 days.

(21) Appl. No.: 16/667,076

(22) Filed: Oct. 29, 2019

(65) Prior Publication Data

US 2020/0173204 A1 Jun. 4, 2020

(30) Foreign Application Priority Data

Dec. 4, 2018 (JP) ..... JP2018-227691

(51) Int. Cl.

| | |
|---|---|
| ***E05B 81/76*** | (2014.01) |
| ***E05B 81/90*** | (2014.01) |
| ***E05B 85/10*** | (2014.01) |
| ***E05B 85/16*** | (2014.01) |
| ***E05B 81/14*** | (2014.01) |

(Continued)

(52) U.S. Cl.

CPC ..... *E05B 81/16* (2013.01); *E05B 7/00* (2013.01); *E05B 47/0001* (2013.01); *E05B 63/18* (2013.01); *E05B 81/76* (2013.01); *E05B 81/90* (2013.01); *E05B 85/103* (2013.01); *E05B 85/16* (2013.01); *E05B 81/14* (2013.01)

(58) Field of Classification Search

CPC ..... E05B 81/16; E05B 81/14; E05B 81/76; E05B 81/90; E05B 85/10; E05B 85/103; E05B 85/107; E05B 85/16

See application file for complete search history.

(56) References Cited

U.S. PATENT DOCUMENTS 6,696,652 B1 * 2/2004 Spies ..... E05B 83/16 200/333
6,698,262 B2 * 3/2004 Wittwer ..... E05B 77/34 292/DIG. 31

(Continued)

FOREIGN PATENT DOCUMENTS

| | | |
|---|---|---|
| JP | 2016-142046 A | 8/2016 |
| JP | 2017-066605 A | 4/2017 |
| JP | 2017-166265 A | 9/2017 |

*Primary Examiner* — Kristina R Fulton
*Assistant Examiner* — Emily G. Brown
(74) *Attorney, Agent, or Firm* — Dinsmore & Shohl LLP

(57) ABSTRACT

A vehicle door device includes: a latch mechanism configured to be switchable between a latch state and an unlatch state; a door handle configured to be movable between a first position and a second position; a door handle projecting mechanism configured to move the door handle from the first position to the second position when a press portion provided on an outer surface of the door handle or in a peripheral portion of the outer surface of the door handle is pressed; and an electrical unlatch operation mechanism including a switch and an electric actuator, the switch being operated by the door handle or the door handle projecting mechanism when the press portion is pressed, and the electric actuator being configured so that, when the switch is operated, the electric actuator is operated to switch the latch mechanism from a latch state to an unlatch state.

3 Claims, 13 Drawing Sheets

(51) Int. Cl.

| | |
|---|---|
| ***E05B 81/16*** | (2014.01) |
| ***E05B 63/18*** | (2006.01) |
| ***E05B 47/00*** | (2006.01) |
| ***E05B 7/00*** | (2006.01) |

(56) References Cited

U.S. PATENT DOCUMENTS

| | | | | |
|---|---|---|---|---|
| 6,863,318 | B2 * | 3/2005 | Mejean | E05B 81/14 292/216 |
| 7,621,573 | B2 * | 11/2009 | Thomas | E05B 85/107 49/501 |
| 10,655,371 | B2 * | 5/2020 | Soonthornwinate | E05B 77/06 |
| 11,268,306 | B2 * | 3/2022 | Ishikawa | E05B 77/12 |
| 2016/0222703 | A1 * | 8/2016 | Koizumi | E05B 85/107 |
| 2017/0089102 | A1 | 3/2017 | Yoshino | |
| 2018/0148957 | A1 * | 5/2018 | Och | E05B 81/76 |

* cited by examiner

FLUSH HANDLE DEVICE FOR CONTROLLING VEHICLE DOOR LATCH

CROSS-REFERENCE TO RELATED APPLICATIONS

This application claims priority to Japanese Patent Application No. 2018-227691 filed on Dec. 4, 2018, which is incorporated herein by reference in its entirety including the specification, drawings and abstract.

BACKGROUND

1. Technical Field

The disclosure relates to vehicle door devices.

2. Description of Related Art

A technique relating to handle devices of vehicle doors is known in the art (see, e.g., Japanese Unexamined Patent Application Publication Nos. 2017-066605 and 2017-166265). For example, Japanese Unexamined Patent Application Publication No. 2017-066605 discloses a technique relating to a vehicle outside handle device having an outside handle whose outer surface is flush with the outer surface of an outer panel when not being operated. In this technique, when an occupant pushes the outside handle to a motor operation position, a switch is pressed, and the outside handle is turned to a hold position (operable position). The occupant then pulls the outside handle to turn it from the hold position to an operation position, whereby a door is unlocked.

SUMMARY

In this technique, however, the occupant needs to perform the two operations to unlock the door. Namely, the occupant needs to first push and then pull the outside handle to unlock the door. There is still room for improvement in simplifying an operation of unlocking the door.

The disclosure provides a vehicle door device capable of simplifying an operation of removing a restriction on opening of a door body.

A vehicle door device according to a first aspect of the disclosure includes: a latch mechanism, a door handle, a door handle projecting mechanism, and an electrical unlatch operation mechanism. The latch mechanism is provided on a door body for a vehicle and is configured to be switchable between a latch stale and an unlatch state when the door body is in a closed state. The latch state is a state in which the latch mechanism is engaged with a striker on a vehicle body side to restrict opening of the door body. The unlatch state is a state in which the latch mechanism is disengaged with the striker so as not to restrict opening of the door body. The door handle is provided in the door body and is configured to be movable between a first position and a second position. The first position is a position in which an outer surface of the door handle is flush with an outer surface of the door body. The second position is a position in which at least a part of the door handle projects to outside of the vehicle with respect to the door handle in the first position so that an operator can hold the door handle. The door handle projecting mechanism is configured to move the door handle from the first position to the second position when a press portion provided on the outer surface of the door handle or in a peripheral portion of the outer surface of the door handle is pressed. The electrical unlatch operation mechanism includes a switch and an electric actuator. The switch is operated by the door handle or the door handle projecting mechanism when the press portion is pressed. The electric actuator is configured so that, when the switch is operated, the electric actuator is operated to switch the latch mechanism from a latch state to an unlatch state.

With the above configuration, the latch mechanism provided on the door body is switchable between the latch state in which the latch mechanism is engaged with the striker to restrict opening of the door body and the unlatch state in which the latch mechanism is disengaged with the striker so as not to restrict opening of the door body, when the door body is in the closed state. The door handle provided in the door body is movable between the first position in which the outer surface of the door handle is flush with the outer surface of the door body and the second position in which at least a part of the door handle projects to the outside of the vehicle with respect to the door handle in the first position so that the operator can hold the door handle. The door handle projecting mechanism moves the door handle from the first position to the second position when the press portion provided on the outer surface of the door handle or in the peripheral portion of the outer surface of the door handle is pressed. The switch of the electrical unlatch operation mechanism is operated by the door handle or the door handle projecting mechanism when the press portion is pressed. The electric actuator of the electrical unlatch operation mechanism is thus operated to switch the latch mechanism from the latch state to the unlatch state. As described above, the operator can switch the latch mechanism from the latch state to the unlatch state by a single action, namely by merely pressing the press portion.

The vehicle door device according to the first aspect of the disclosure may further include: a mechanical unlatch operation mechanism configured to switch the latch mechanism from the latch state to the unlatch state in conjunction with predetermined movement of the door handle.

With the above configuration, the mechanical unlatch operation mechanism switches the latch mechanism from the latch state to the unlatch state in conjunction with the predetermined movement of the door handle. Accordingly, the operator can switch the latch mechanism from the latch state to the unlatch state even if a power failure occurs.

In the vehicle door device according to the first aspect of the disclosure, the door handle may be configured so as to move to a third position when operated from the second position in a direction in which the door body is opened, the third position including a position located further to the outside of the vehicle than the second position, and the mechanical unlatch operation mechanism may be configured so that, when the latch mechanism is in the latch state and the door handle is moved from the second position to the third position, the mechanical unlatch operation mechanism switches the latch mechanism from the latch state to the unlatch state in conjunction with the movement of the door handle.

With the above configuration, when the door handle is operated from the second position in the direction in which the door body is opened, the door handle moves to the third position that includes the position located further to the outside of the vehicle than the second position. When the latch mechanism is in the latch state and the door handle is moved from the second position to the third position, the mechanical unlatch operation mechanism switches the latch mechanism from the latch, state to the unlatch state in conjunction with the movement of the door handle. Accordingly, the operation load at the time of moving the door handle from the first position to the second position is restrained. Moreover, when there is no power failure, the operation load at the time of moving the door handle from the second position to the third position is also restrained.

In the vehicle door device according to the first aspect of the disclosure, the door handle may be disposed so that a longitudinal direction of the door handle extends in a horizontal direction as viewed from a front side of a door and may be configured to move between the first position and the second position as the door handle is turned about an axis of a shaft extending in a vertical direction of the door. The shalt may be disposed at such a position in the longitudinal direction of the door handle that is located on one side in the longitudinal direction of the door handle as viewed from the front side of the door and that is located other than in an end in the longitudinal direction of the door handle, and the press portion may be provided on an end of the outer surface of the door handle which is located on the one side in the longitudinal direction of the door handle. The door handle projecting mechanism may be configured to turn the door handle from the first position to the second position when the press portion is pressed. The switch of the electrical unlatch operation mechanism may be disposed so as to face an inner surface of an end of the door handle which is located on the one side in the longitudinal direction of the door handle.

With the above configuration, the door handle is disposed so that its longitudinal direction extends in the horizontal direction as viewed from the front side of the door and is movable between the first position and the second position as the door handle is turned about the axis of the shaft extending in the vertical direction of the door. The shaft is disposed at such a position in the longitudinal direction of the door handle that is located on the one side in the longitudinal direction of the door handle as viewed from the front side of the door and that is located other than in the end in the longitudinal direction of the door handle, and the press portion is provided on the end of the outer surface of the door handle which is located on the one side in the longitudinal direction of the door handle. The door handle projecting mechanism turns the door handle from the first position to the second position when the press portion is pressed. The switch of the electrical unlatch operation mechanism is disposed so as to face the inner surface of the end of the door handle which is located on the one side in the longitudinal direction of the door handle. Even though the configuration is simple, the switch is thus operated when the press portion is pressed.

In the vehicle door device according to the first aspect of the disclosure, the door handle may have a U-shape that opens upward or toward a side as viewed from a front side of a door and may be configured to move between the first position and the second position as the door handle is turned about an axis of a first shaft that extends through both ends of the U-shape in a direction in which the ends face each other. The door handle projecting mechanism may include a flap and a lever. The flap may be disposed inside the U-shape of the door handle as viewed from the front side of the door, may include a base portion through which the first shaft extends, and may be configured to turn about the axis of the first shaft. The flap may include a press plate and a protruding portion, the press plate extending from the base portion toward a bottom of the U-shape of the door handle and having the press portion on an outer surface of the press plate, and the protruding portion protruding from the base portion toward an inner side of the door. The press portion may be configured so that, when not being pressed, the press portion is aligned with the door handle in the first position by a biasing force of a spring. The flap may be configured so that, when the press portion is pressed, the flap is turned and the protruding portion operates the switch of the electrical unlatch operation mechanism. The lever may have a V-shape as viewed in an axial direction of the first shaft may have its first end contacting an inner surface of the press plate and its second end contacting an inner surface of the bottom of the U-shape of the door handle, and may be configured to turn about an axis of a second shaft that is disposed parallel to the first shaft at a position closer to the first end than a bend is. The lever may be configured so that, when the press portion is pressed and the flap is turned accordingly, the first end of the lever is pushed by the press plate and the lever is turned accordingly, and the second end of the lever pushes the door handle toward the second position.

With the above configuration, the door handle having a U-shape that opens upward or toward a side as viewed from the front side of the door is movable between the first position and the second position as the door handle is turned about the axis of the first shaft that extends through both ends of the U-shape in the direction in which the ends face each other. The door handle projecting mechanism includes the flap disposed inside the U-shape of the door handle as viewed front the front side of the door. The flap includes the base portion through switch the first shaft extends, so that the flap can turn about the axis of the first shaft. The flap includes the press plate and the protruding portion. The press plate extends from the base portion toward the bottom of the U-shape of the door handle and has the press portion on its outer surface. The protruding portion protrudes from the base portion toward the inner side of the door. The press portion is configured so that, when not being pressed, the press portion is aligned with the door handle in the first position by the biasing force of the spring. When the press portion is pressed, the flap is turned and the protruding portion operates the switch of the electrical unlatch operation mechanism.

The door handle projecting mechanism further includes the lever having a V-shape as viewed in the axial direction of the first shaft. The lever has a first end contacting the inner surface of the press plate and a second end contacting the inner surface of the bottom of the U-shape of the door handle and can turn about the axis of the second shaft. The second shaft is disposed parallel to the first shaft at a position closer to the first end than the bend is. When the press portion is pressed and the flap is turned accordingly, the first end of the fever is pushed by the press plate and the lever is turned accordingly, and the second end of the lever pushes the door handle toward the second position. The operator can thus easily hold the bottom of the U-shape of the door handle after pressing the flap.

As described above, according to the vehicle door device of each aspect of the disclosure, the operation of removing a restriction on opening of the door body can be simplified.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

First Embodiment

A vehicle door device according to a first embodiment of the disclosure will be described with reference to FIGS. 1 to 11B. In these figures, arrow RR indicates the direction toward the rear of a vehicle, arrow UP indicates the direction toward the upper side of the vehicle, and arrow OUT indicates the direction toward the outer side in the lateral direction of the vehicle. The directions used in the following description are the directions at the time a side door 20 is in a closed state.

Figure 1:
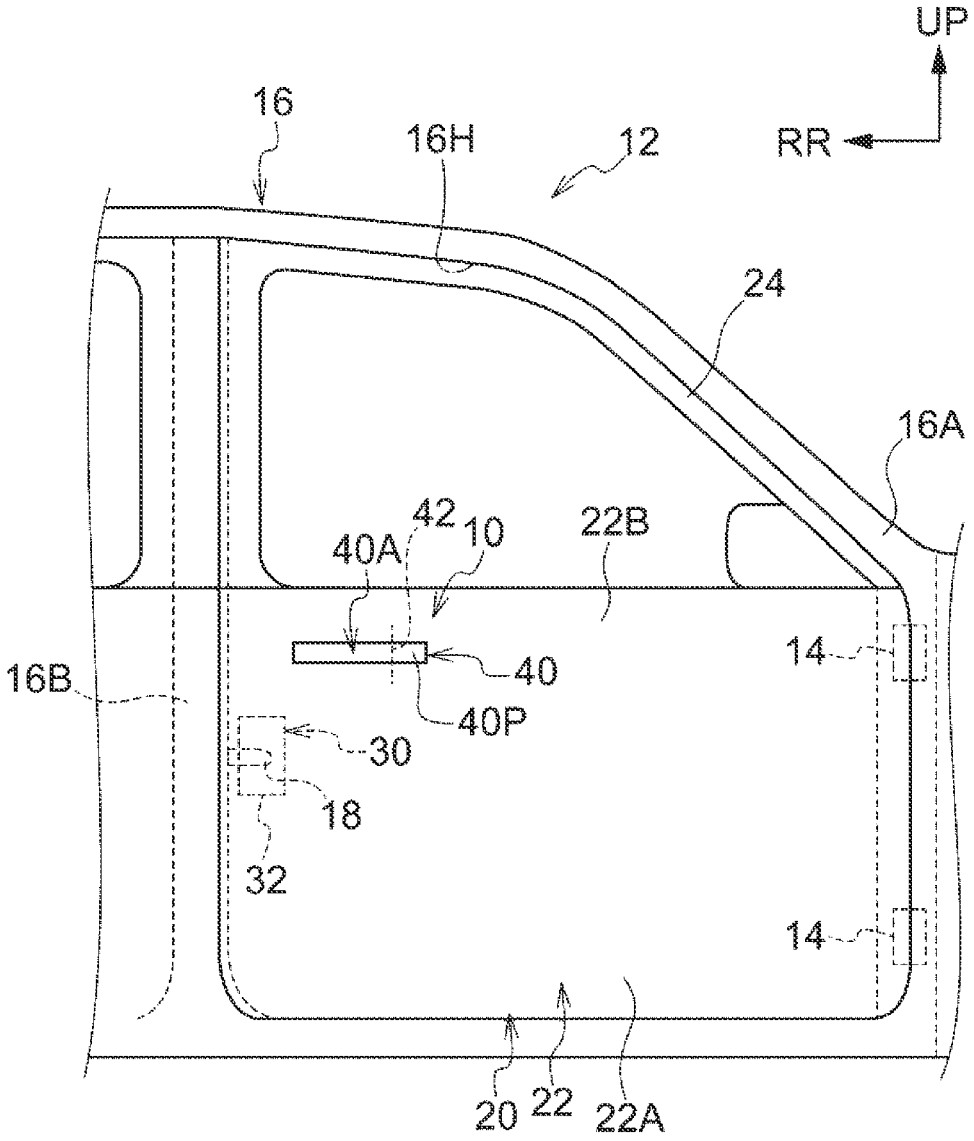
FIG. 1 is a schematic side view showing the configuration of a part of an automobile to which a vehicle door device according to a first embodiment is applied.

FIG. 1 is a schematic side view of a part of an automobile 12 to which a vehicle doer device 10 according to the present embodiment is applied. As shown in the figure, the automobile 12 includes a side door 20. The side door 20 has its front end tumably coupled to an A-pillar 16A of a vehicle body 16 via a pair of upper and lower hinges 14. The vehicle body 16 has a door opening 16H on its side so that an occupant can get in and out of the automobile 12 through the door opening 16H. The side door 20 can open and close the door opening 16H.

The side door 20 includes a door body 22, a door frame 24, and a door trim (not shown). The door frame 24 is used as a window frame and is coupled to the upper part of the door body 22. The door trim is attached to the interior side of the door body 22 in a passenger compartment. The door body 22 includes a metal door outer panel 22A and a metal door inner panel (not shown). The door outer panel 22A forms an outer panel of the door body 22 which is disposed on the outer side in the lateral direction of the vehicle, and the door inner panel forms an inner panel of the door body 22 which is disposed on the inner side in the lateral direction of the vehicle. The door outer panel 22A extends in the vertical and longitudinal directions of the vehicle. The door outer panel 22A has a convex horizontal section as viewed from above the vehicle. Namely, the door outer panel 22A is curved so that its intermediate part in the longitudinal direction of the vehicle is located on the outer side in the lateral direction of the vehicle, as viewed from above the vehicle. The door outer panel 22A also has a convex longitudinal section as viewed from the front side of the vehicle. Namely, the door outer panel 22A is curved so that its intermediate part in the vertical direction of the vehicle is located on the outer side in the lateral direction of the vehicle, as viewed from the front side of the vehicle. The door inner panel (not shown) extends in the vertical and longitudinal directions of the vehicle and has its front, rear, and lower ends joined to the front, rear, and lower ends of the door outer panel 22A by hemming. An internal space is thus created in the door body 22.

Figure 2:
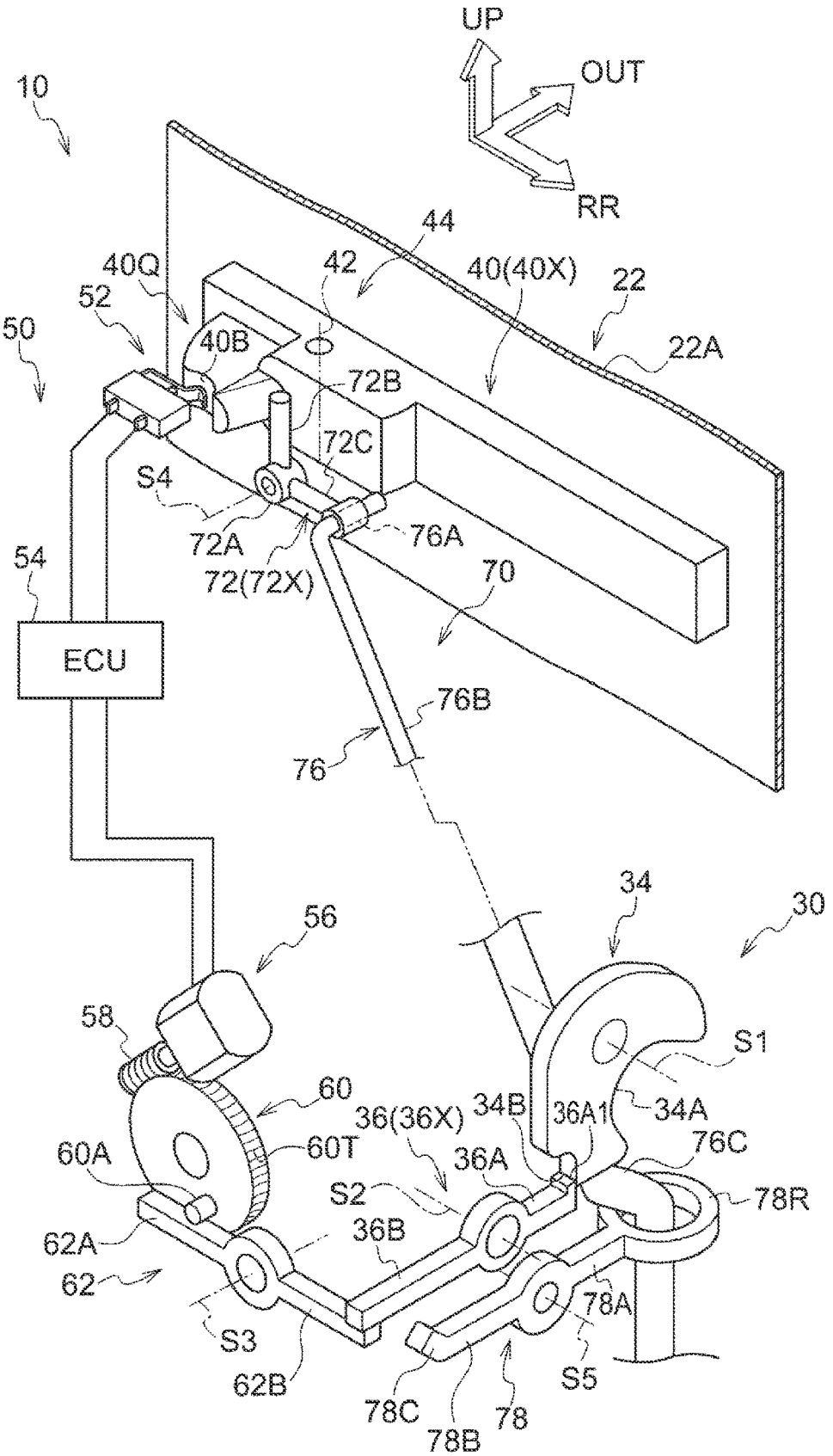
FIG. 2 is a perspective view showing a schematic configuration of the vehicle door device according to the first embodiment as viewed from the inner side of a door.

FIG. 2 is a perspective view showing a schematic configuration of the vehicle door device 10 according to the first embodiment as viewed from the inner side of the door. As shown in FIG. 2, the vehicle door device 10 includes a latch mechanism 30 on the inner side of the door body 22. For better understanding of the configuration of the latch mechanism 30, the latch mechanism 30 and its peripheral portion are shown enlarged in FIG. 2. As shown in FIG. 1, the latch mechanism 30 is disposed at the rear end of the door body 22 in the longitudinal direction of the vehicle and includes a base member 32 (schematically shown in the figure) fixed to the door body 22. The latch mechanism 30 further includes a latch 34 supported by the base member 32 via a support shaft S1 shown in FIG. 2 (only the central axis of the support shaft S1 is shown in the figure). The support shaft S1 is disposed so that its axis extends in the longitudinal direction of the vehicle. The latch 34 is rotatable about the support shaft S1 between a latch position 34X shown in FIG. 3B and an unlatch position 34Y shown in FIG. 9B. The latch 34 is biased toward the unlatch position 34Y shown in FIG. 9B by a spring, not shown (see arrow D).

Figure 3B:
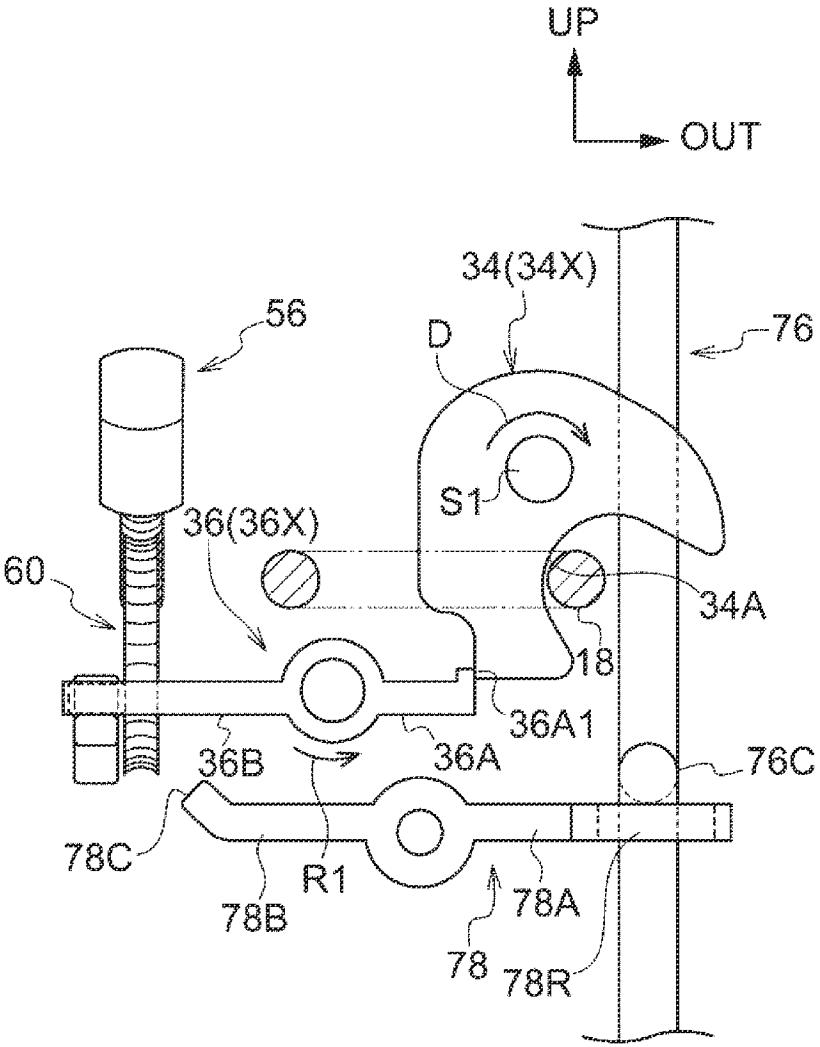
FIG. 3B is a view showing the latch mechanism as viewed in the direction of arrow 3B in FIG.3A.
Figure 3A:
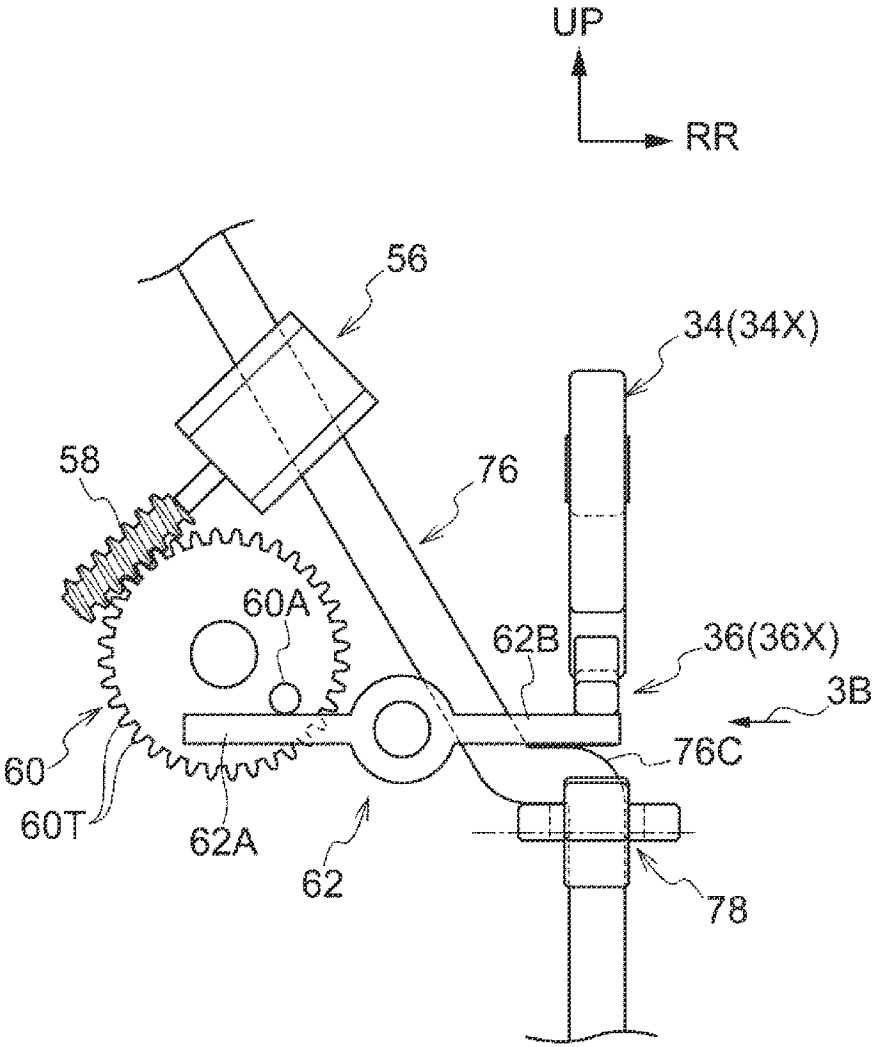
FIG. 3A is a view showing a latch mechanism of FIG. 2 in a latch state as viewed from the inner side of the door.

As shown in FIG. 3B, the latch 34 has an engagement recess 34A for catching a striker 18 (see FIG. 1). As shown in FIG. 1, the striker 18 is fixed to a B-pillar 16B of the vehicle body 16. Although not shown in the figure, the striker 18 has a U-shape as viewed from above the vehicle. The latch mechanism 30 shown in FIG. 2 is switchable between a latch state and an unlatch state when the door body 22 shown in FIG. 1 is in a closed state. When the latch mechanism 30 is in the latch state, the latch 34 located at the latch position 34X (see FIG. 3B) engages with the striker 18 on the vehicle body 16 side and restricts opening of the door body 22. When the latch mechanism 30 is in the unlatch state, the latch 34 located at the unlatch position 34Y (see FIG. 9B) does not engage with the striker 18 and does not restrict opening of the door body 22.

As shown in FIG. 2, the latch 34 has a stop portion 34B which is in the form of a cutout, in its outer periphery. When the latch 34 is engaged with the striker 18 (see FIG. 3B), the stop portion 34B is stopped by a lip end stop portion 36A1 of a first arm 36A of a pole 36, whereby rotation of the latch 34 is stopped. The tip end stop portion 36A1 is a part of the tip end of the first arm 36A which protrudes upward.

The pole 36 is supported by the base member 32 (see FIG. 1) via a support shaft S2 (only its central axis is shown in the figure). The support shaft S2 is disposed so that its axis extends in the longitudinal direction of the vehicle. The pole 36 is rotatable around the support shaft S2 between a lock position 36X shown in FIGS. 2 to 3B and an unlock position 36Y shown in FIGS. 8 to 11B. The pole 36 is biased toward the lock position 36X shown in FIG. 3B by a spring, not shown (see arrow R1). The pole 36 operates in conjunction with operation of a door handle (also referred to as the "outside handle") 40 provided in the door body 22 shown in FIG. 2. When the door handle 40 is operated, the pole 36 is turned to the unlock position 36Y (see FIGS. 8 and 10).

Figure 4:
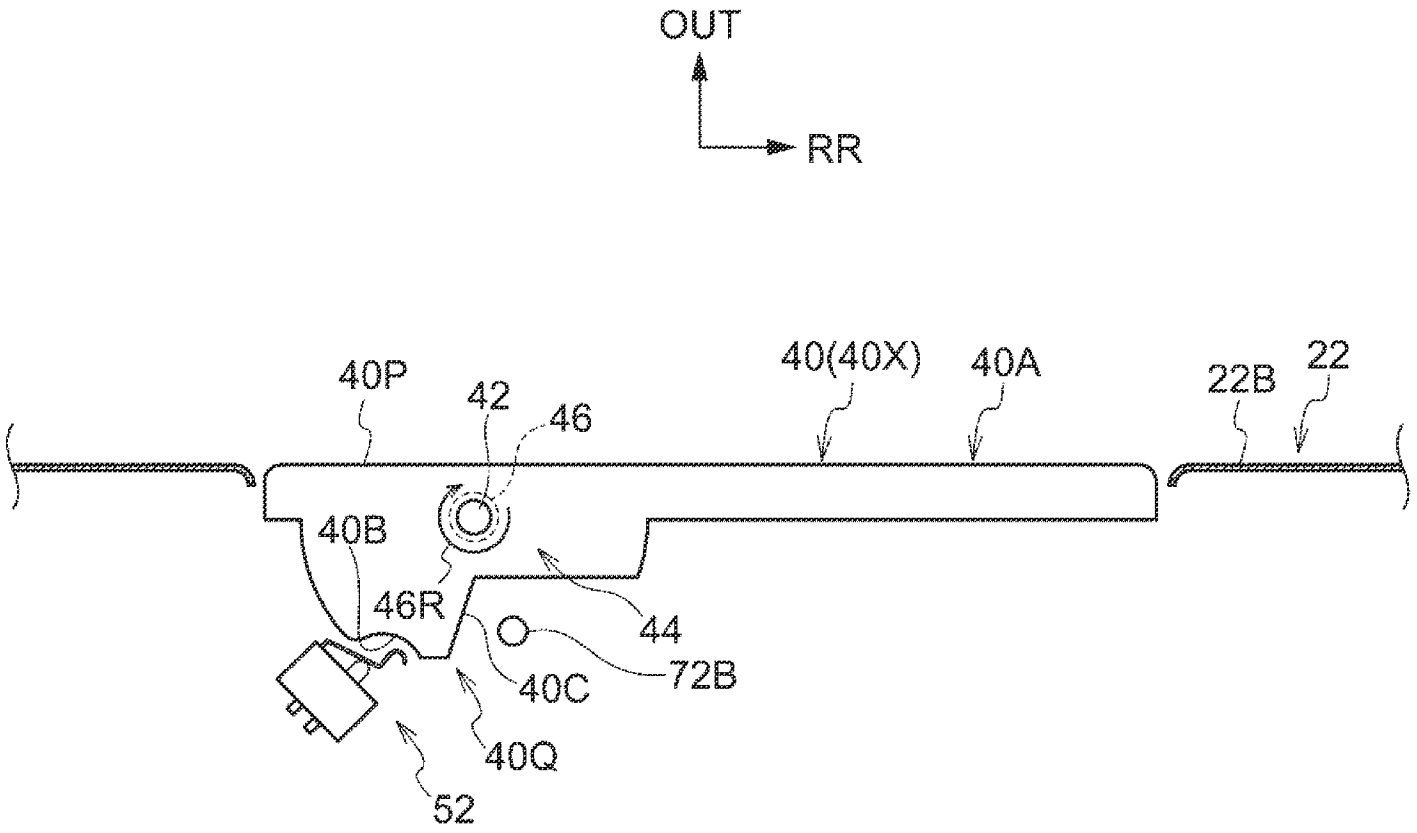
FIG. 4 is a horizontal section showing a door handle in a stored state (located at a first position)
Figure 5:
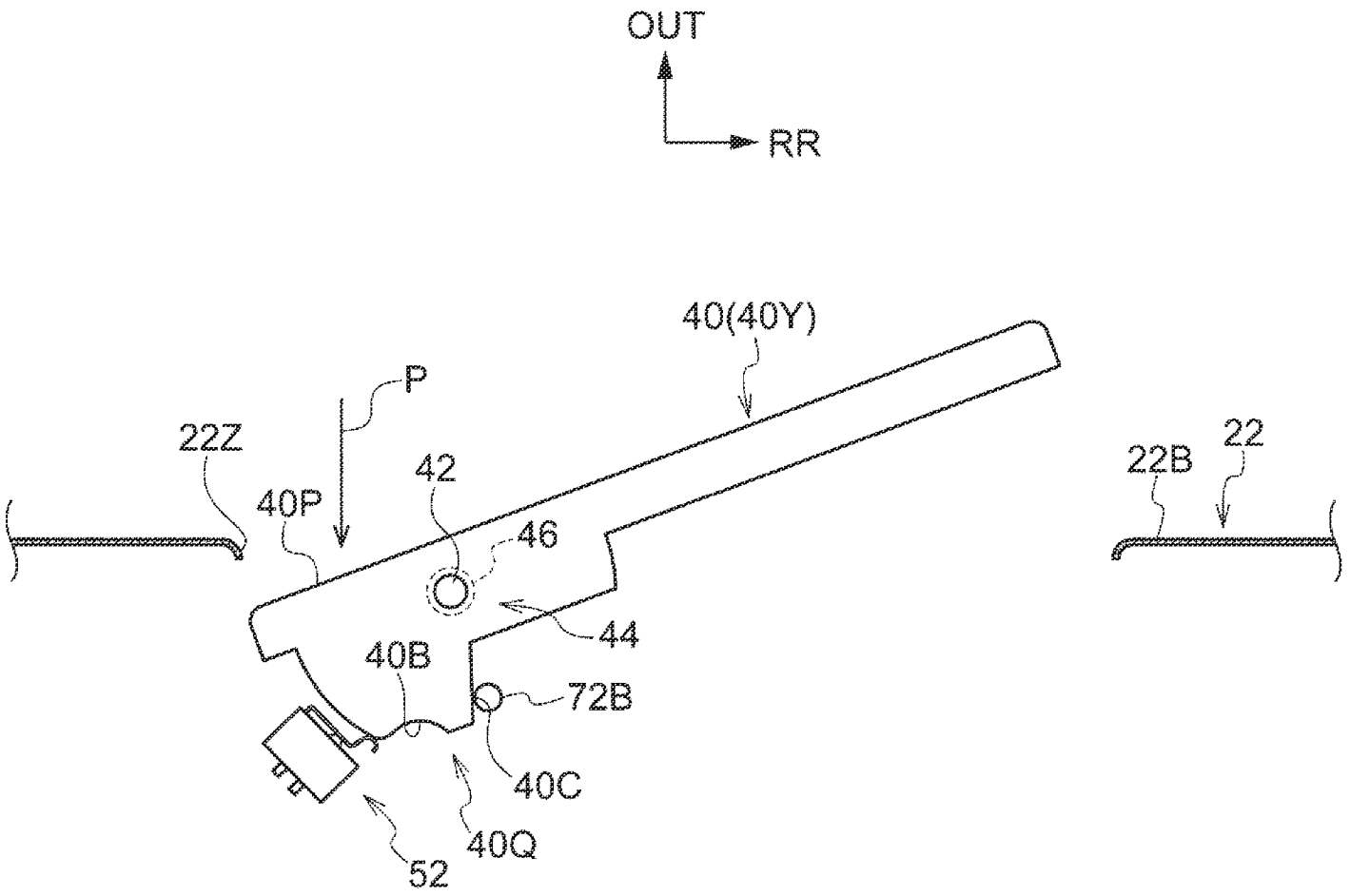
FIG. 5 is a horizontal section showing the door handle moved to a second position as a press portion of the door handle in the state shown in FIG. 4 is pressed.

FIG. 4 is a horizontal sectional view showing the door handle 40 in a stored state. The door handle 40 is movable between a first position 40X shown in FIG. 4 and a second position 40Y shown in FIG. 5. When the door handle 40 is in the first position 40X, an outer surface 40A of the door handle 40 is flush with an outer surface 22B of the door body 22. When the door handle 40 is in the second position 40Y, a part of the door handle 40 projects to the outside of the vehicle with respect to the door handle 40 in the first position 40X so that the operator can hold the door handle 40. As shown in FIG. 1, the door handle 40 is disposed so that its longitudinal direction extends in the horizontal direction as viewed from the front side of the door. As shown in FIGS. 4 and 5, the door handle 40 is movable between the first position 40X and the second position 40Y as the door handle 40 is turned about the axis of a shaft 42 extending in the vertical direction of the door. The door handle 40 is biased toward the first position 40X shown in FIG. 4 by a spring 46 for the door handle 40 (e.g., a torsion coil spring) (see arrow 46R).

As shown in FIG. 1, the shaft 42 is disposed at such a position in the longitudinal direction of the door handle 40 that is located on the front side in the longitudinal direction of the vehicle, namely on one side in the longitudinal direction of the door handle 40, as viewed from the front side of the door, and that is located other than in the end in the longitudinal direction of the door handle 40. A press portion 40P is provided on the front end of the outer surface 40A of the door handle 40 in the longitudinal direction of the vehicle (the end of the outer surface 40A of the door handle 40 which is located on the one side in the longitudinal direction of the door handle 40) as shown in FIG. 1. The press portion 40P is a portion that is used to move the door handle 40 from the first position 40X shown in FIG. 4 to the second position 40Y shown in FIG. 5. That is, the vehicle door device 10 of the present embodiment includes a door handle projecting mechanism 44 that turns the door handle 40 from the first position 40X shown in FIG. 4 to the second position 40Y shown in FIG. 5 when the press portion 40P is pressed. In FIG. 5, the direction in which the press portion 40P is pressed is shown by arrow P.

As shown in FIG. 4, the door handle 40 has a protruding portion 40Q protruding toward the inner side of the door. The protruding portion 40Q is formed on a part of the inner surface of the door handle 40 which is located closer to the front end of the door handle 40 in the longitudinal direction of the vehicle (i.e., closer to the end on the one side in the longitudinal direction of the door handle 40). The protruding portion 40Q has a curved surface 40B at its top. The curved surface 40B is concavely curved toward the outer side of the door. The protruding portion 40Q further has a tilted surface 40C on its side on the rear side of the vehicle. The tilted surface 40C extends toward the inner side of the door and is slightly lilted toward the front side of the vehicle.

As shown in FIG. 2, the vehicle door device 10 includes an electrical unlatch operation mechanism 50 that causes the pole 36 to operate in conjunction with operation of the door handle 40. The electrical unlatch operation mechanism 50 includes a switch 52 disposed so as to face the protruding portion 40Q of the door handle 40. The switch 52 is connected to an ECU (shown as a block in the figure; also referred to as the "control device") 54. The switch 52 is configured to output an operation signal when pressed. An electric motor 56, which serves an electric actuator for unlatching, is connected to the ECU 54. When the switch 52 is pressed, the ECU 54 operates the electric motor 56 according to the operation signal from the switch 52.

A first gear 58 is coaxially fixed to an output shaft of the electric motor 56. A second gear 60 is disposed so that its axis extends in the lateral direction of the vehicle, and the first gear 58 meshes with the second gear 60. The second gear 60 has a larger diameter than the first gear 58. The second gear 60 has teeth 60T on its outer peripheral surface and has a pin-like protrusion 60A on its side surface. The protrusion 60A is formed so that its axis extends in the lateral direction of the vehicle. The protrusion 60A contacts the upper surface of a first arm 62A of a lever 62. The lever 62 is supported by the base member 32 (see FIG. 1) via a support shaft S3 (only its central axis is shown in the figure) and is rotatable about the support shaft S3. The support shaft S3 is disposed so that its axis extends in the lateral direction of the vehicle. The lever 62 has a second arm 62B extending in the opposite direction from the first arm 62A. The lower surface of the tip end of a second arm 36B of the pole 36 contacts the upper surface of the tip end of the second arm 62B. The second arm 36B of the pole 36 extends in the opposite direction from the first arm 36A of the pole 36.

Figure 9B:
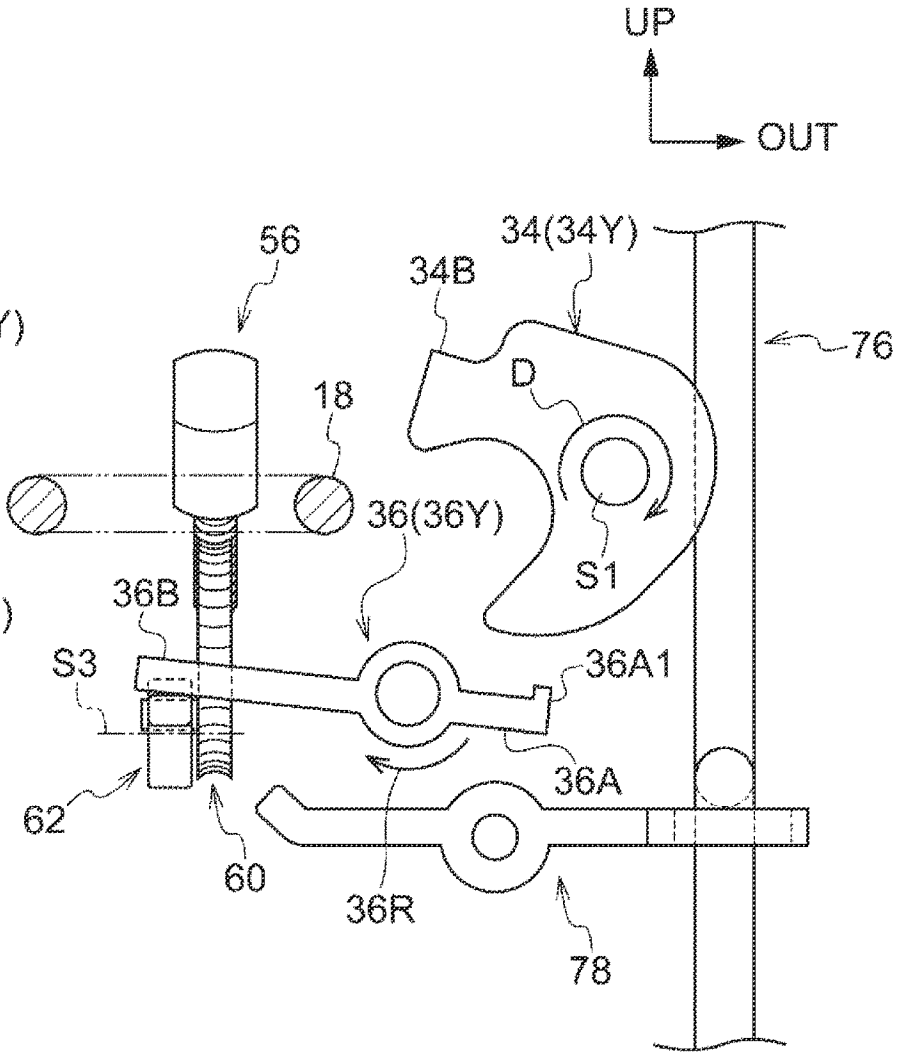
FIG. 9B is a view showing the state as viewed in the direction of arrow 9B in FIG. 9A.
Figure 9A:
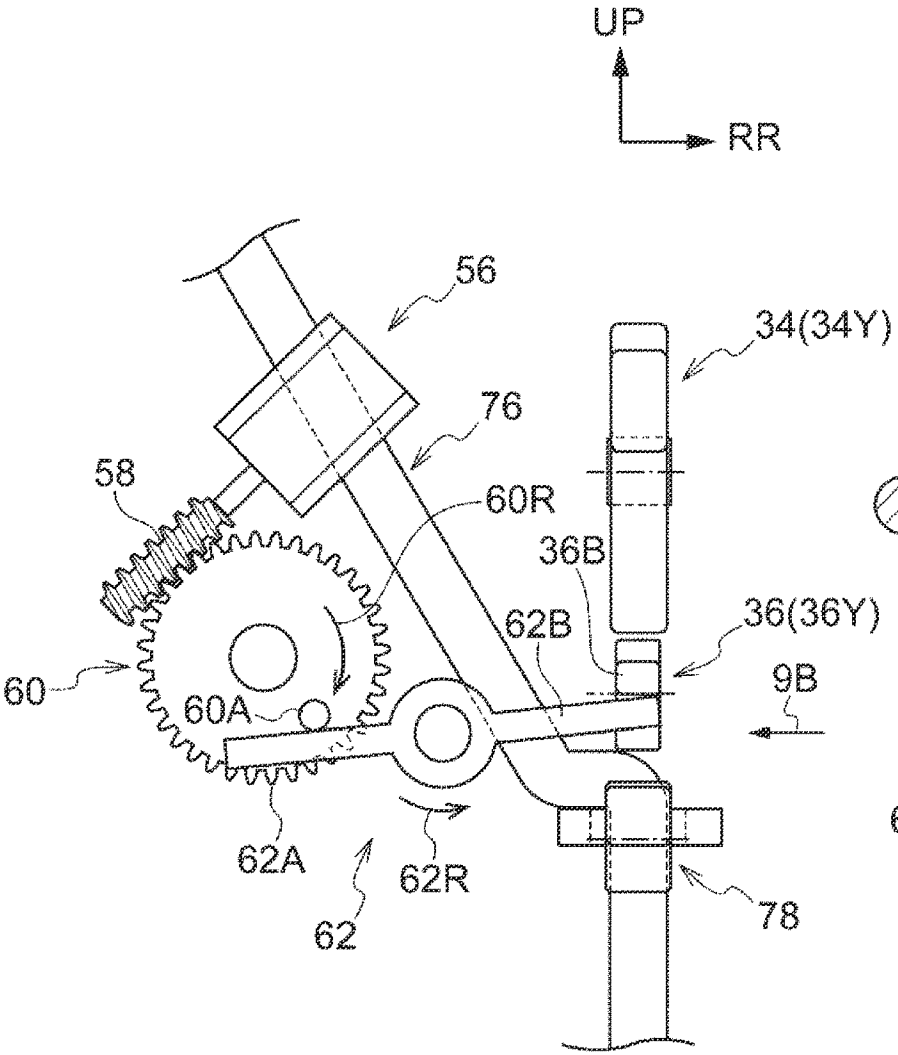
FIG. 9A is a view showing the electrical unlatch operation mechanism being operated, as viewed from the inner side of the door.

As shown in FIGS. 9A and 9B, when the electric motor 56 is operated, the first gear 58 and the second gear 60 are rotated, whereby the protrusion 60A pushes down the first arm 62A of the lever 62, and at the same time, the second arm 62B of the lever 62 pushes up the second arm 36B of the pole 36. When the second arm 36B of the pole 36 is pushed up, the first arm 36A of the pole 36 moves down, so that the tip end stop portion 36A1 of the first arm 36A of the pole 36 is disengaged from the stop portion 34B of the latch 34. When the tip end stop portion 36A1 of the first arm 36A of the pole 36 is disengaged from the stop portion 34B of the latch 34, the latch 34 is rotated to the unlatch position 34Y by the biasing force of the spring, not shown (see arrow D).

The electrical unlatch operation mechanism 50 is configured as follows. When the press portion 40P (see FIG. 2) is pressed, the switch 52 is operated by the protruding portion 40Q on the inner surface of the door handle 40. The electric motor 56 is thus operated, and the latch mechanism 30 is switched from the latch state to the unlatch state.

Figure 6:
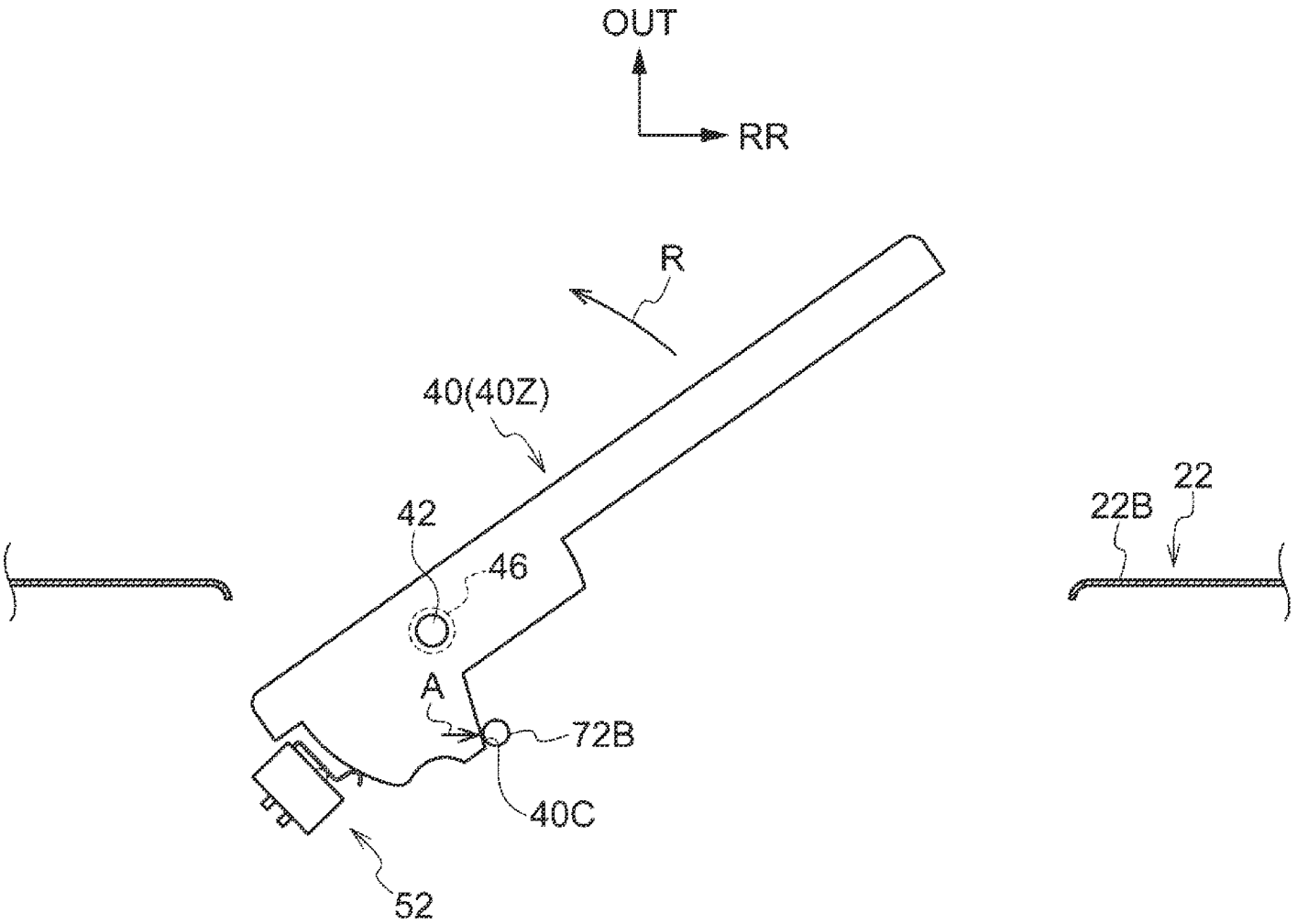
FIG. 6 is a horizontal section showing the door handle moved to a third position as the door handle in the slate shown in FIG. 5 is pulled.
Figure 7A:
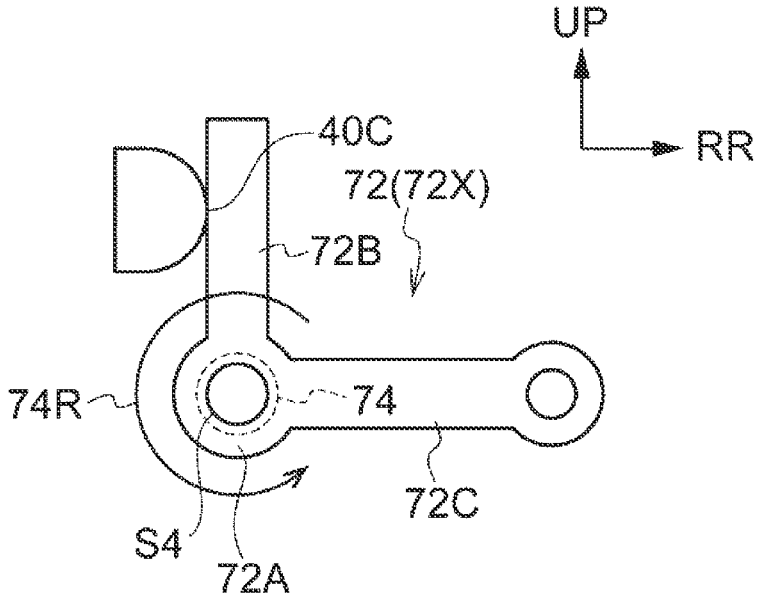
FIG. 7A is a view showing how the state of a crank mechanism is changed as viewed from the inner side of the door, and shows the state of the crank mechanism at the time the door handle is in the state shown in FIG. 5.
Figure 7B:
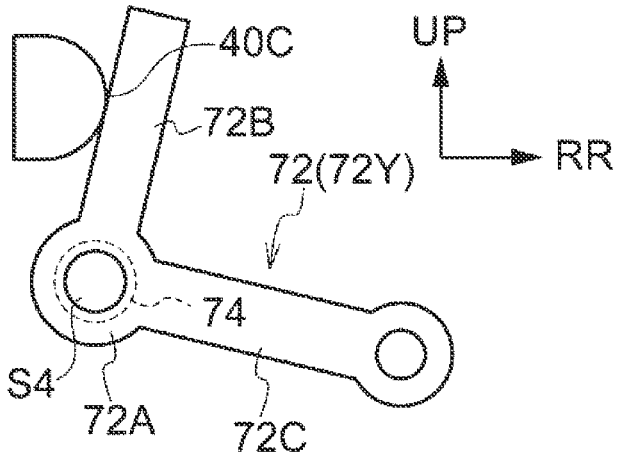
FIG. 7B shows the state of the crank mechanism at the time the door handle is in the state shown in FIG. 6.

As shown in FIG. 6, the door handle 40 is configured to move to a third position 40Z when it is operated from the second position 40Y (see FIG. 5) in the direction in which the door body 22 is opened (see arrow R). The third position 40Z includes a position located further to the outside of the vehicle than the second position 40Y (see FIG. 5). As shown in FIG. 2, the vehicle door device 10 includes a mechanical unlatch operation mechanism 70 that causes the door handle 40 and the pole 36 to mechanically operate together.

The mechanical unlatch operation mechanism 70 includes a crank mechanism 72 on the inner side of the door handle 40. The crank mechanism 72 has an L-shape as viewed in the lateral direction of the vehicle, and a first arm 72B and a second arm 72C extend from a base portion 72A of the crank mechanism 72. The crank mechanism 72 is supported by the door body 22 via a support shaft S4 (only its central axis is shown in the figure) extending through the base portion 72A. The support shaft S4 is placed so that its axis extends in the lateral direction of the vehicle. The crank mechanism 72 is rotatable about the support shaft S4 between a reference position 72X shown in FIG. 7A and an operating position 72Y shown in 7B. The crank mechanism 72 is biased toward the reference position 72X by a spring 74 for the crank mechanism 72 (e.g., a torsion coil spring) (see arrow 74R).

When the door handle 40 is located at the first position 40X shown in FIG. 4, the first arm 72B of the crank mechanism 72 is located away from the tilted surface 40C of the inner surface of the door handle 40. When the door handle 40 is located at the second position 40Y shown in FIG. 5, the first arm 72B contacts the tilted surface 40C. When the door handle 40 is located at the third position 40Z shown in FIG. 6, the first arm 72B is pushed by the tilted surface 40C (see arrow A).

As shown in FIG. 2, a tip end 76A is a part of the rod 76 and is bent toward the outer side of the door. The tip end 76A is inserted through the tip end of the second arm 72C of the crank mechanism 72 so that the rod 76 is rotatable about the axis of the tip end 76A in the lateral direction of the vehicle. The rod 76 includes a long intermediate portion 76B extending downward toward the rear of the vehicle and a lower part 76C bent like a crank from the lower end of the intermediate portion 76B.

The lower part 76C of the rod 76 is inserted through a ring portion 78R of a lever 78 with a ring (hereinafter simply referred to as the "lever 78"). The ring portion 78R is formed in the tip end of a first arm 78A of the lever 78, and the lever 78 is disposed so that the lower part 76C of the rod 76 extends through the ring portion 78R in the vertical direction of the vehicle. The lever 78 has a second arm 78B on the opposite side from the first arm 78A and has a bent portion 78C at the tip end of the second arm 78B. The bent portion 78C is bent obliquely upward in the vertical direction of the vehicle toward the inner side in the lateral direction of the vehicle. The bent portion 78C is disposed directly below the second arm 36B of the pole 36. The lever 78 is supported by the base member 32 (see FIG. 1) via a support shaft S3 (only its central axis is shown in the figure) and is rotatable about the support shaft S5. The support shaft S5 is disposed so that its axis extends in the longitudinal direction of the vehicle.

Figure 10:
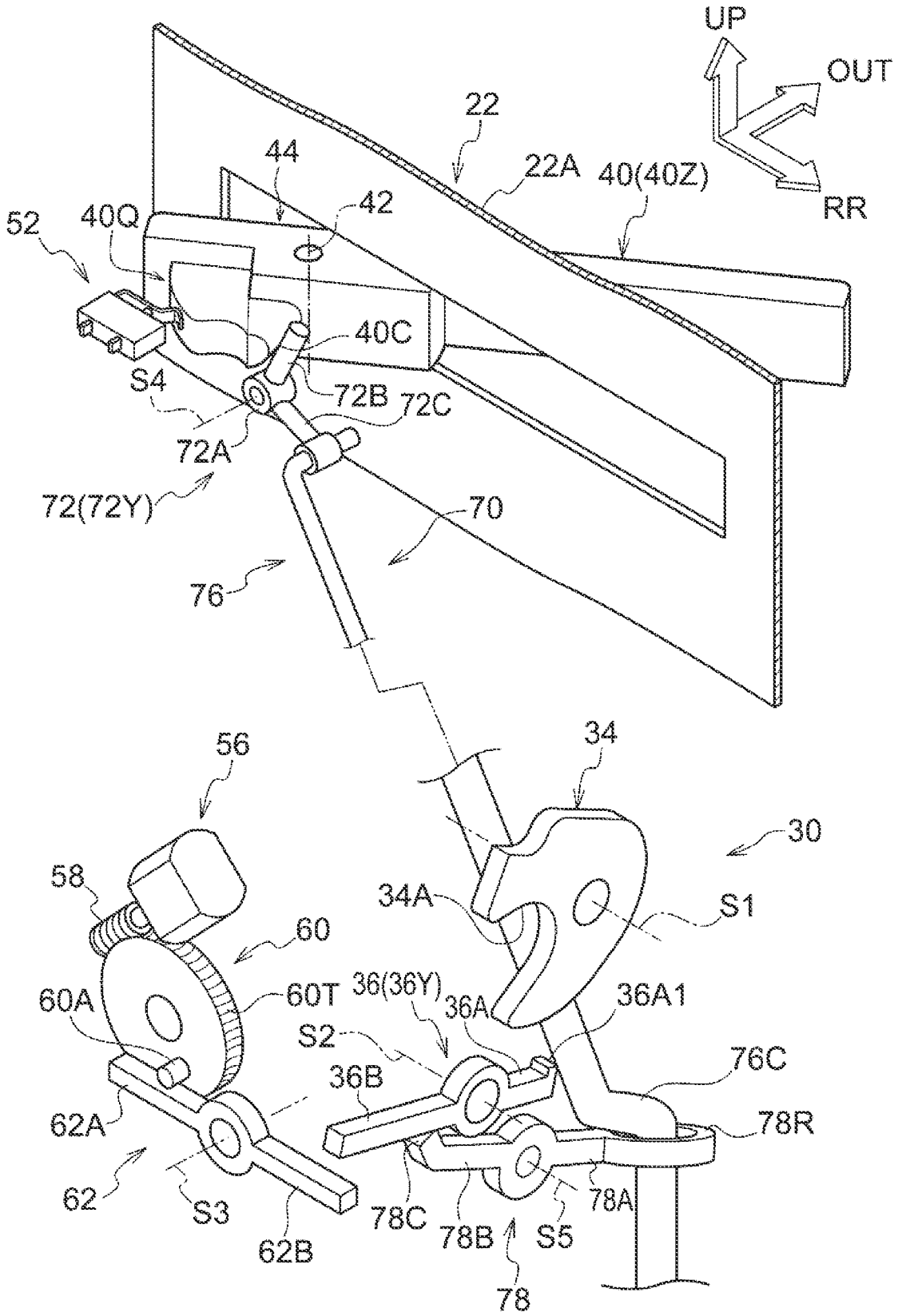
FIG. 10 is a perspective view showing a mechanical unlatch operation mechanism being operated as the door handle is pulled by an operator, as viewed from the inner side of the door.

When the door handle 40 is turned from the second position 40Y shown in FIG. 5 to the third position 40Z shown in FIG. 6 the tilted surface 40C of the inner surface of the door handle 40 pushes the crank mechanism 72 shown in FIG. 10, so that the crank mechanism 72 is rotated and the rod 76 is moved down. When the rod 76 is moved down, the rod 76 pushes down the ring portion 78R of the lever 78 shown in FIGS. 11A and 11B, so that the lever 78 is rotated (see arrow B). The bent portion 78C of the lever 78 thus pushes up the second arm 36B of the pole 36, so that the pole 36 is rotated (see arrow C). The first arm 36A of the pole 36 is thus moved down, whereby the tip end stop portion 36A1 of the first arm 36A of the pole 36 is disengaged from the stop portion 34B of the latch 34. When the tip end stop portion 36A1 of the first arm 36A of the pole 36 is disengaged from the stop portion 34B of the latch 34, the latch 34 is rotated to the unlatch position 34Y by the spring (not shown) (see arrow D).

As described above, when the latch mechanism 30 is in the latch state and the door handle 40 is moved from the second position 40Y (see FIG. 5) to the third position 40Z (see FIG. 6), the mechanical unlatch operation mechanism 70 shown in FIG. 2 switches the latch mechanism 30 from the latch state to the unlatch state in conjunction with the movement of the door handle 40 as shown in FIG. 10.

Functions and effects of the present embodiment will be described below.

Figure 8:
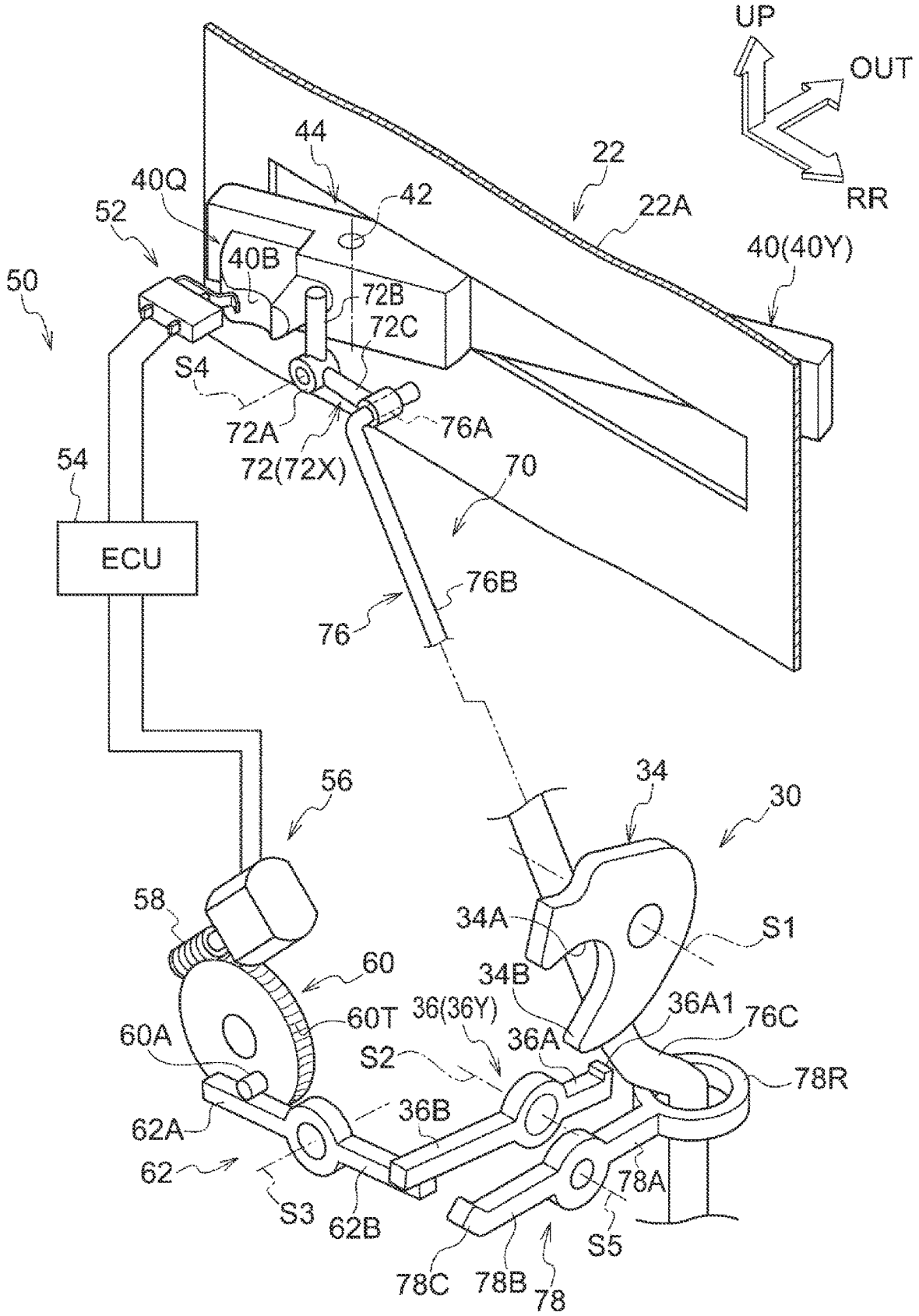
FIG. 8 is a perspective view showing an electrical unlatch operation mechanism being operated as the door handle of FIG. 2 is pressed, as viewed from the inner side of the door.

In the present embodiment, when the press portion 40P provided on the outer surface 40A of the door handle 40 shown in FIG. 1 is pressed, the door handle projecting mechanism 44 shown in FIG. 2 moves the door handle 40 from the first position 40X shown in FIG. 4 to the second position 40Y shown in FIG. 5. At this time, the switch 52 is operated by the protruding portion 40Q formed on the inner surface of the door handle 40. The electric motor 56 of the electrical unlatch operation mechanism 50 shown in FIG. 8 is thus operated to switch the latch mechanism 30 from the latch state to the unlatch state. As described above, the operator can switch the latch mechanism 30 from the latch state to the unlatch state by a single action, namely by merely pressing the press portion 40P (see FIG. 1).

Operation of the electrical unlatch operation mechanism 50 will further be described. When the electric motor 56 shown in FIG. 9A is operated, the first gear 58 is rotated and thus the second gear 60 is rotated accordingly (see arrow 60R), whereby the protrusion 60A of the second gear 60 pushes down the first arm 62A of the lever 62. The lever 62 is thus rotated (see arrow 62R) and the second arm 62B of the lever 62 pushes up the second arm 36B of the pole 36. As shown in FIG. 9B, when the second arm 36B of the pole 36 is pushed up, the pole 36 is rotated (see arrow 36R). The first arm 36A of the pole 36 is therefore moved down, and the tip end stop portion 36A1 of the first arm 36A of the pole 36 is disengaged from the stop portion 34B of the latch 34. At this time, the latch 34 is rotated to the unlatch position 34Y by the biasing force of the spring, not shown (see arrow D), and the latch 34 is disengaged from the striker 18.

In the present embodiment, as shown in FIG. 1, the door handle 40 is disposed so that its longitudinal direction extends in the horizontal direction as viewed from the front side of the door. The door handle 40 is movable between the first position 40X shown in FIG. 4 and the second position 40Y shown in FIG. 5 as the door handle 40 is turned about the axis of the shaft 42 extending in the vertical direction of the door. As shown in FIG. 1, the shaft 42 is disposed at such a position in the longitudinal direction of the door handle 40 that is located on the front side in the longitudinal direction of the vehicle, namely on the one side in the longitudinal direction of the door handle 40, as viewed from the front side of the door, and that is located other than in the end in the longitudinal direction of the door handle 40. The press portion 40P is provided on the front end of the outer surface 40A of the door handle 40 in the longitudinal direction of the vehicle (the end of the outer surface 40A of the door handle 40 which is located on the one side in the longitudinal direction of the door handle 40). The door handle projecting mechanism 44 shown in FIG. 4 turns the door handle 40 from the first position 40X to the second position 40Y shown in FIG. 5 when the press portion 40P is pressed. As shown in FIGS. 2 and 4, the switch 52 of the electrical unlatch operation mechanism 50 (see FIG. 2) is disposed so as to face the inner surface (protruding portion 40Q) of the front end of the door handle 40 in the longitudinal direction of the vehicle (the end of the door handle 40 which is located on the one side in the longitudinal direction of the door handle 40). Even though the configuration is simple, the switch 52 is thus operated as shown in FIG. 5 when the press portion 40P shown in FIG. 4 etc. is pressed.

As described above, according to the vehicle door device 10 of the present embodiment, an operation of removing a restriction on opening of the door body 22 can be simplified.

After the operator removes the restriction on opening of the door body 22 he/she may hold the door handle 40 to open the door body 22 or may hold an edge 22Z of an opening of the door handle 40 in which the door handle 40 is placed to open the door body 22. The present embodiment thus provides flexibility in operation by the operator.

In the present embodiment, the door handle 40 is moved to the third position 40Z shown in FIG. 6 when operated from the second position 40Y in the direction in which the door body 22 is opened, and the third position 40Z includes a position located further to the outside of the vehicle than the second position 40Y. When the latch mechanism 30 shown in FIG. 2 is in the latch state and the door handle 40 is moved from the second position 40Y (see FIG. 5) to the third position 40Z (see FIG. 6), the mechanical unlatch operation mechanism 70 switches the latch mechanism 30 from the latch state to the unlatch state in conjunction with the movement of the door handle 40 as shown in FIG. 10. Accordingly, the operator can switch the latch mechanism 30 from the latch state to the unlatch state even if a power failure occurs.

Figure 11B:
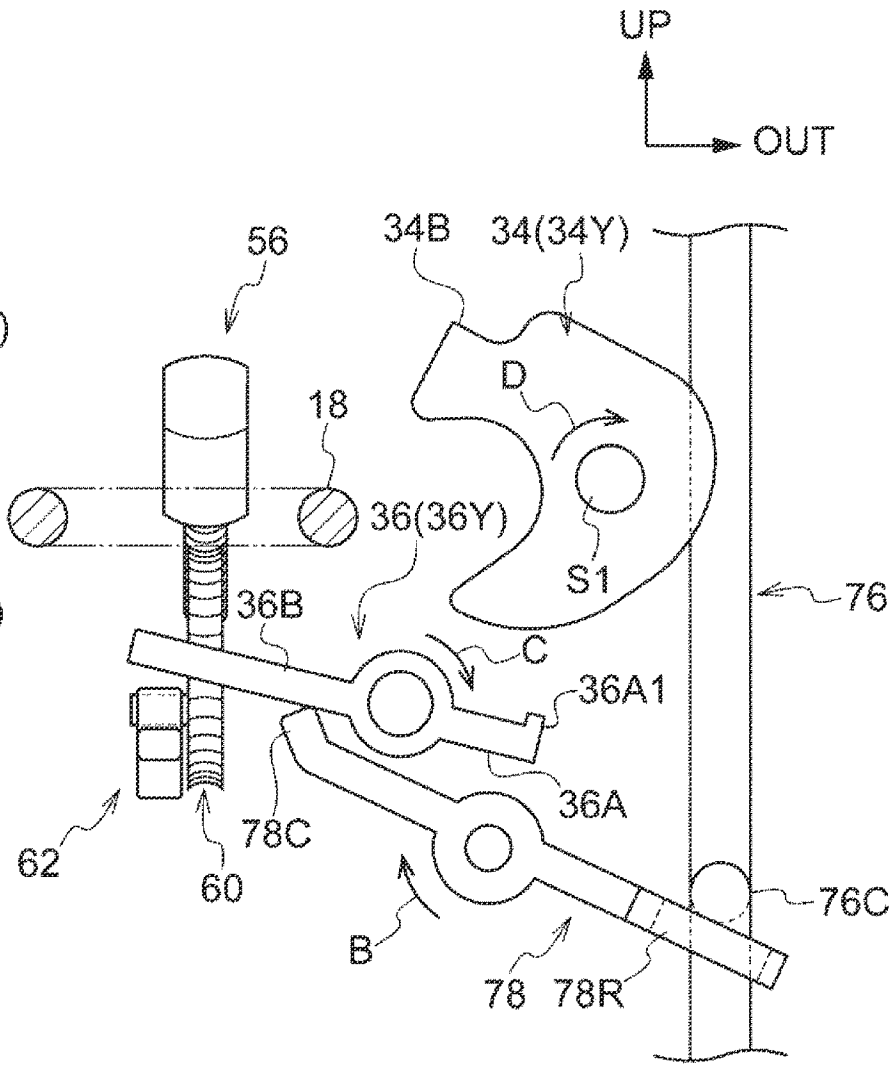
FIG. 11B is a view showing the state as viewed in the direction of arrow 11B in FIG. 11A.
Figure 11A:
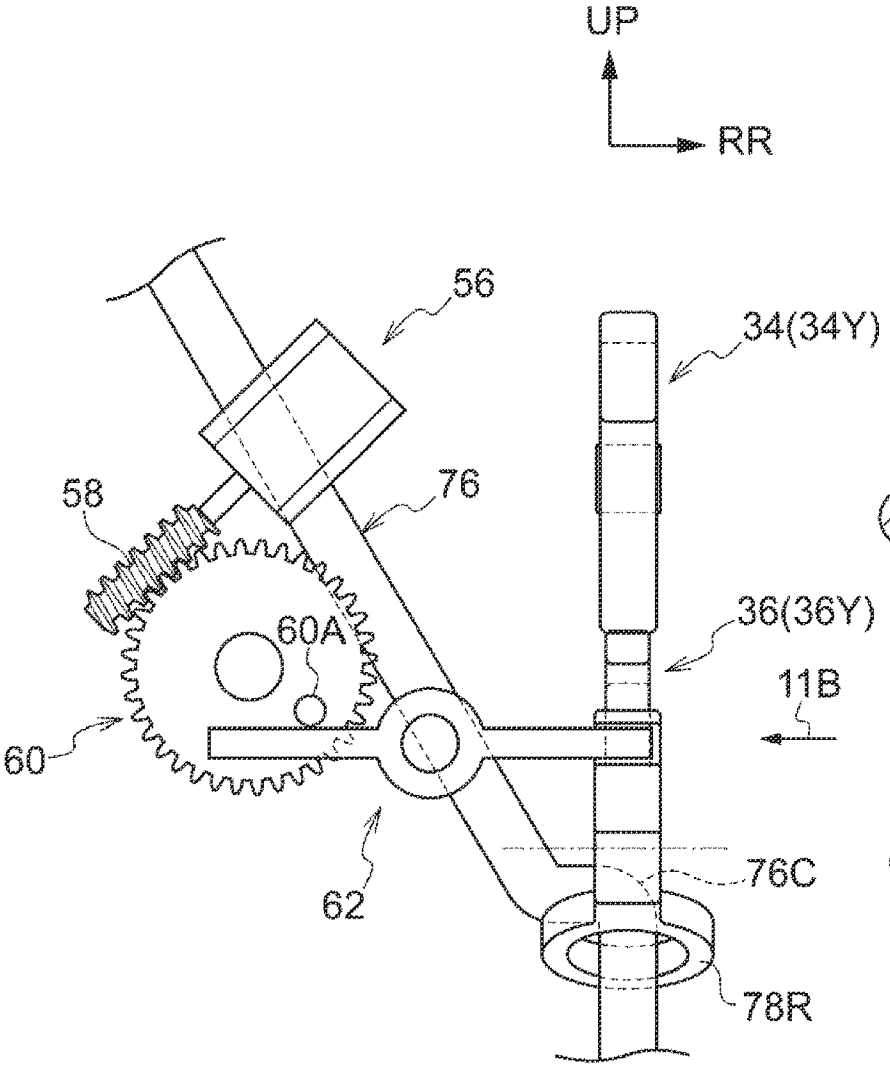
FIG. 11A is a view showing the mechanical unlatch operation mechanism being operated, as viewed from the inner side of the door.

Operation of the mechanical unlatch operation mechanism 70 will further be described. When the door handle 40 is turned from the second position 40Y shown in FIG. 5 to the third position 40Z shown in FIG. 6, the tilted surface 40C of the inner surface of the door handle 40 pushes the crank mechanism 72, so that the crank mechanism 72 is rotated, as shown in FIG. 10. The rod 76 is thus moved down. When the rod 76 is moved down, the lower part 76C of the rod 76 pushes down the ring portion 78R of the lever 78, so that the lever 78 is rotated (see arrow B), as shown in FIGS. 11A and 11B. The bent portion 78C of the lever 78 thus pushes up the second arm 36B of the pole 36, so that the pole 36 is rotated (see arrow C). At this time, the first arm 36A of the pole 36 is moved down. The tip end stop portion 36A1 of the first arm 36A of the pole 36 is thus disengaged from the stop portion 34B of the latch 34. When the tip end stop portion 36A1 of the first arm 36A of the pole 36 is disengaged from the stop portion 34B of the latch 34, the latch 34 is rotated to the unlatch position 34Y by the biasing force of the spring, not shown (see arrow D), so that the latch 34 is disengaged from the striker 18.

The operation load at the time of moving the door handle 40 from the first position 40X shown in FIG. 4 to the second position 40Y shown in FIG. 5 is restrained. Moreover, when there is no power failure, the operation load at the time of moving the door handle 40 from the second position 40Y to the third position 40Z shown in FIG. 6 is also restrained.

Second Embodiment

Figure 12B:
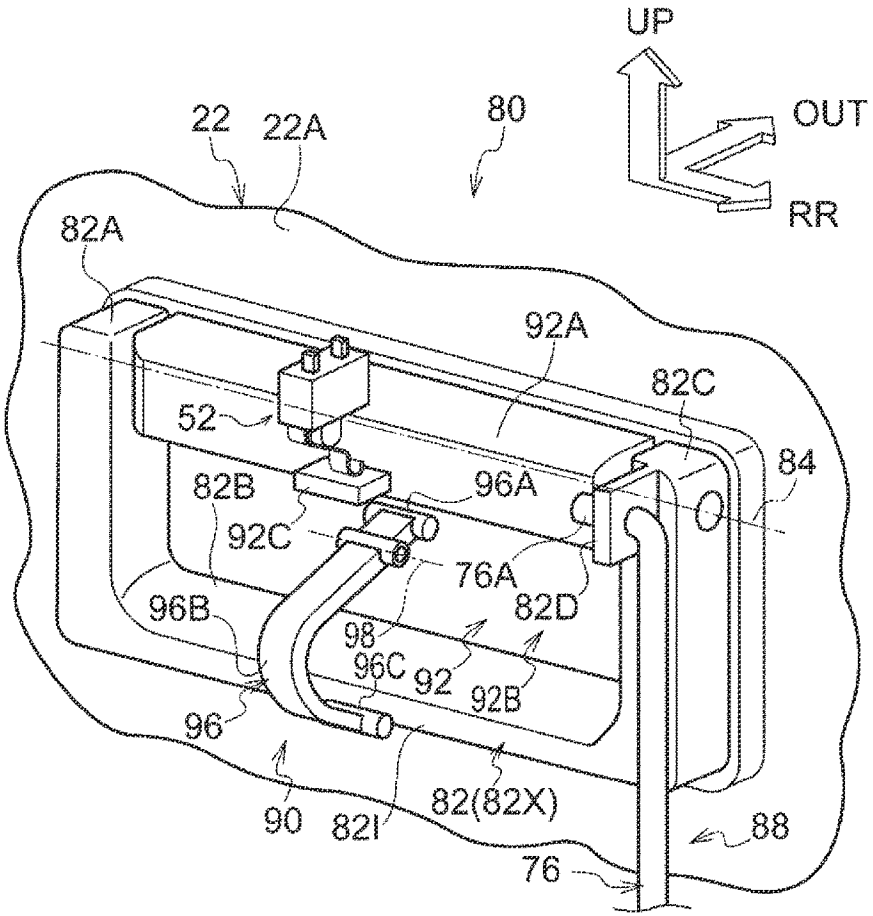
FIG. 12B is a perspective view of a vehicle door device according to a second embodiment with a door handle being in a stored state.
Figure 12A:
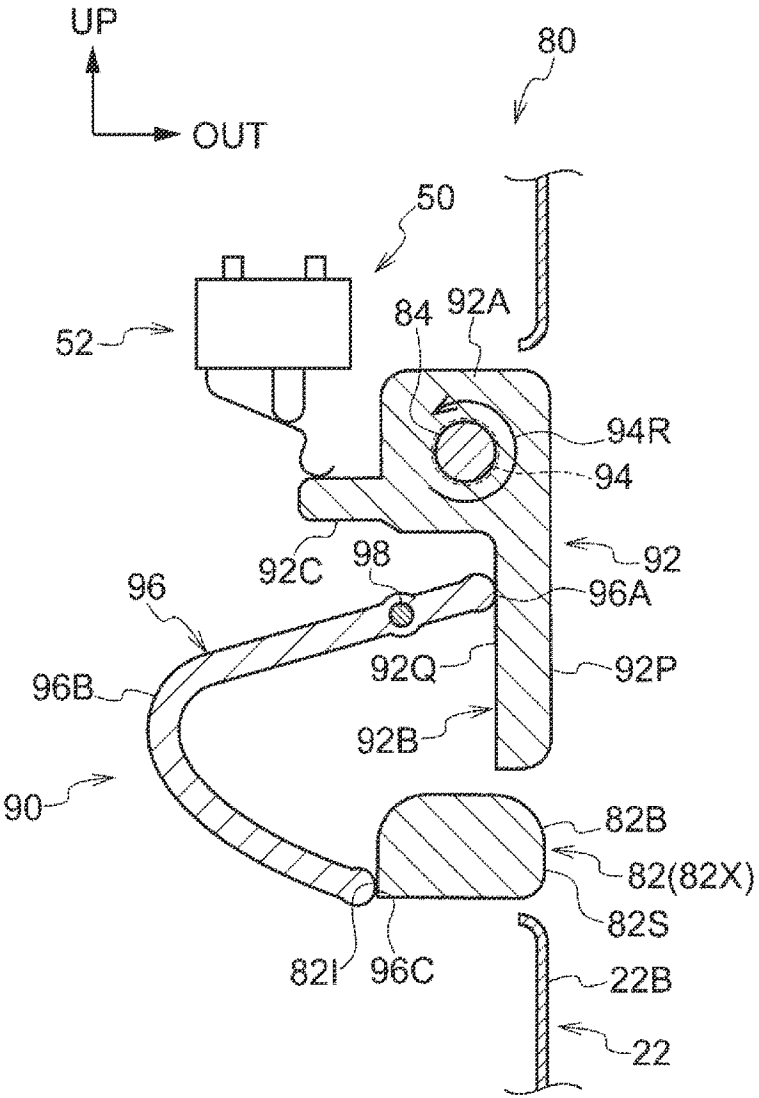
FIG. 12A is a longitudinal section of a vehicle door device according to a second embodiment with a door handle being in a stored state, as viewed from the rear side of a door.
Figure 13B:
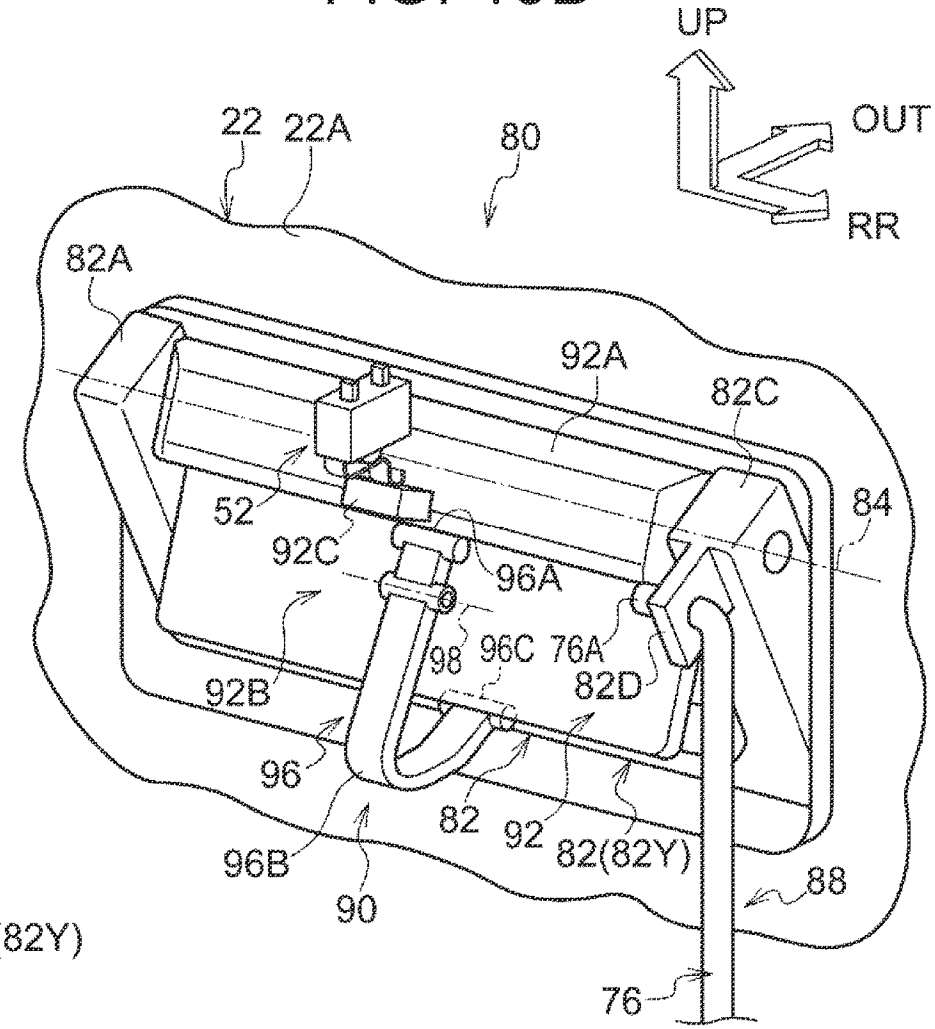
FIG. 13B is a perspective view as viewed in a direction similar to that of FIG. 12B.
Figure 13A:
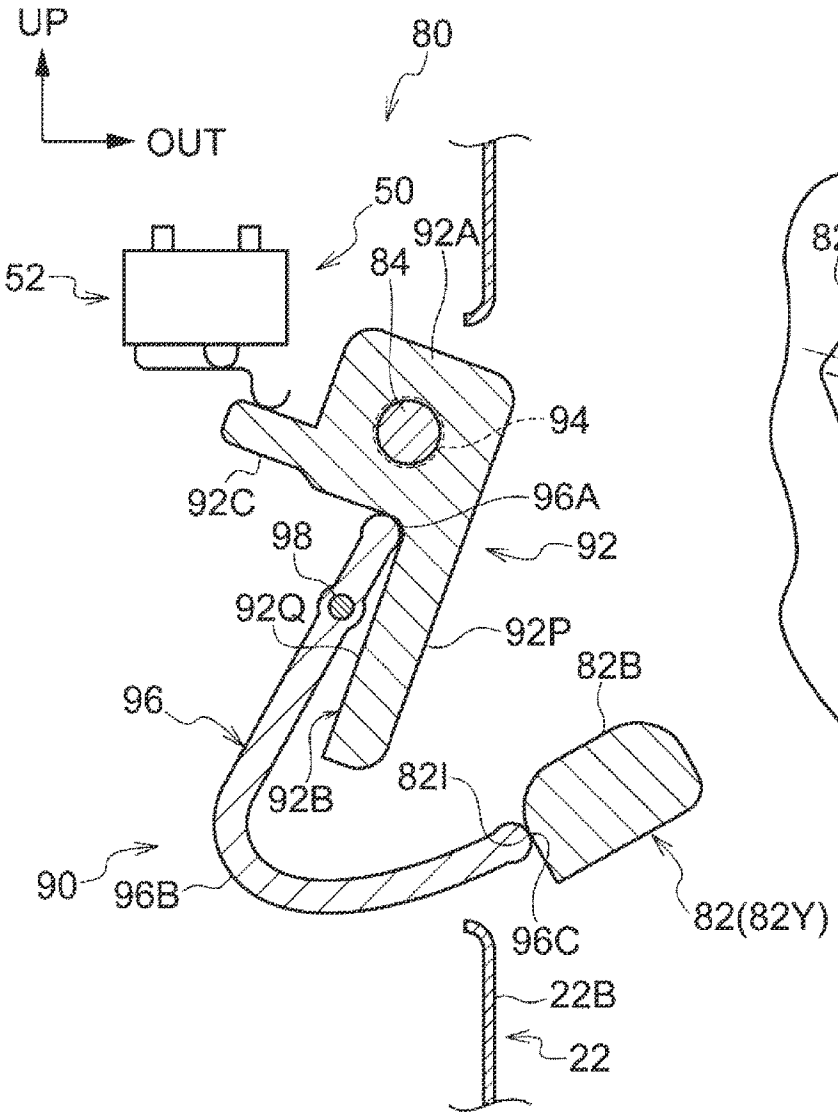
FIG. 13A is a view showing a flap, which is a peripheral portion of the door handle, being pressed, and is a longitudinal section taken at a position similar to that of FIG. 12A.

A vehicle door device according to a second embodiment of the disclosure will be described with reference to FIGS. 12A to 13B. FIGS. 12A and 12B show a vehicle door device 80 of the present embodiment with a door handle 82 being in a stored state, FIGS. 13A and 13B show the vehicle door device 80 with a flap 92 being pushed. The flap 92 forms a peripheral portion of the door handle 82. The present embodiment has a configuration substantially similar to that of the first embodiment except for the points described below. The constituent portions substantially similar to those of the first embodiment are therefore denoted with the same reference characters, and description thereof will be omitted.

The door handle 82 shown in FIGS. 12A and 12B has a U-shape that opens upward as viewed from the front side of the door. The door handle 82 is movable between a first position 82X and a second position 82Y (see FIGS. 13A and 13B) as the door handle 82 is turned about the axis of a first shaft 84 (only its central axis is shown in FIG. 12B) that extends through both ends 82A, 82C of the U-shape in the direction in which the ends 82A, 82C face each other. When the door handle 82 is in the first position 82X, an outer surface 82S of the door handle 82 is flush with the outer surface 22B of the door body 22. When the door handle 82 is in the second position 82Y, a part of the door handle 82 projects to the outside of the vehicle with respect to the door handle 82 in the first position 82X so that the operator can hold the door handle 82. The door handle 82 is biased toward the first position 82X shown in FIGS. 12A and 12B by a spring for the door handle 82 (not shown).

As shown in FIG. 12B, the door handle 82 has a protruding portion 82D. The protruding portion 82D protrudes toward the inner side of the door from an upper end 82C located on the rear side of the vehicle. The tip end 76A of the rod 76 is inserted through the protruding portion 82D so that the rod 76 is rotatable about the axis of the tip end 76A in the longitudinal direction of the vehicle. A mechanical unlatch mechanism 88 of the present embodiment does not include the crank mechanism 72 of the first embodiment shown in FIG. 2 etc. but has a configuration substantially similar to the rod 76 and the lever 78 of the mechanical unlatch operation mechanism 70 of the first embodiment. The vehicle door device 80 of the present embodiment shown in FIGS. 12A and 12B has a configuration substantially similar to the electrical unlatch operation mechanism 50 and the latch mechanism 30 of the first embodiment shown in FIG. 2 etc.

As shown in FIGS. 12A and 12B, a door handle projecting mechanism 90 of the present embodiment includes the flap 92 disposed inside the U-shape of the door handle 82 as viewed from the front side of the door, and a lever 96 described in detail below. The flap 92 includes a base portion 92A through which the first shaft 84 extends, so that the flap 92 can turn about the axis of the first shaft 84. The flap 92 further includes a press plate 92B and a protruding portion 92C. The press plate 92B extends from the base portion 92A toward a bottom 82B of the U-shape of the door handle 82 and has a press portion 92P on its outer surface. The protruding portion 92C protrudes from the base portion 92A toward the inner side of the door. The press portion 92P is provided in a peripheral portion of the outer surface 82S of the door handle 82. The press portion 92P is configured so that, when not being pressed, the press portion 92P is aligned with the door handle 82 in the first position 82X by the biasing force of a spring 94 (e.g., a torsion coil spring) (see arrow 94R). The switch 52 is in contact with the upper surface of the protruding portion 92C. The flap 92 is configured so that, when the press portion 92P is pressed, the flap 92 is turned and the protruding portion 92C operates the switch 52 of the electrical unlatch operation mechanism 50 (see FIGS. 13A and 13B).

The lever 96 has a substantially V-shape as viewed in the axial direction of the first shaft 84. The lever 96 is disposed so that its first end 96A contacts an inner surface 92Q of the press plate 92B and its second end 96C contacts an inner surface 82I of the bottom 82B of the U-shape of the door handle 82. The lever 96 can turn about the axis of a second shaft 98 (only its central axis is shown in FIG. 12B) that is disposed parallel to the first shaft 84 at a position closer to the first end 96A than a bend 96B is. The flap 92 is turned when the press portion 92P is pressed. As the flap 92 is turned, the press plate 92B pushes the first end 96A of the lever 96. The lever 96 is thus turned, so that the second end 96C of the lever 96 pushes the door handle 82 toward the second position 82Y (sec FIGS. 13A and 13B).

As described above, the door handle projecting mechanism 90 of the present embodiment moves the door handle 82 from the first position 82X to the second position 82Y (see FIGS. 13A and 13B) when the press portion 92P of the flap 92 is pressed.

According to the present embodiment, when the press portion 92P of the flap 92 is pressed, the flap 92 of the door handle projecting mechanism 90 is turned, so that the switch 52 of the electrical unlatch operation mechanism 50 is operated by the protruding portion 92C of the flap 92 as shown in FIGS. 13A and 13B. As in the first embodiment, the operator can thus switch the latch mechanism from the latch state to the unlatch state by a single action, namely by merely pressing the press portion 92P.

In the present embodiment, the flap 92 is turned when the press portion 92P is pressed. As the flap 92 is turned, the press plate 92B pushes the first end 96A of the lever 96. The lever 96 is thus turned, so that the second end 96C of the lever 96 pushes the door handle 82 toward the second position 82Y. The operator can thus easily hold the bottom 82B of the U-shape of the door handle 82 after pressing the flap 92.

In the present embodiment, the rod 76 is moved down when the operator presses the press portion 92P and the door handle 82 is moved to the second position 82Y. The operator can therefore switch the latch mechanism from the latch state to the unlatch state even if a power failure occurs.

Modifications of Embodiments

In a modification of the first embodiment shown in FIGS. 1 to 11B, the shaft provided at the turning center of the door handle may be disposed at such a position in the longitudinal direction of the door handle that is located on the rear side in the longitudinal direction of the vehicle, namely on one side in the longitudinal direction of the door handle, as viewed from the front side of the door, and that is located other than in the end in the longitudinal direction of the door handle. In this modification, the press portion is provided on the rear end of the outer surface of the door handle in the longitudinal direction of the vehicle (the end of the outer surface of the door handle which is located on the one side in the longitudinal direction of the door handle), and the switch of the electrical unlatch operation mechanism is disposed so as to face the inner surface of the rear end of the door handle in the longitudinal direction of the vehicle (the end of the door handle which is located on the one side in the longitudinal direction of the door handle).

In a modification of the second embodiment shown in FIGS. 12A to 13B, the door handle may have a U-shape that opens toward a side as viewed from the front side of the vehicle and may be movable between a first position and a second position as the door handle is turned about the axis of a first shaft that extends through both ends of the U-shape in the direction in which the ends face each other.

In another modification of the second embodiment, the door handle 82 may be configured to move to a third position, which includes a position located further to the outside of the vehicle than the second position 82Y, when it is operated from the second position 82Y in the direction in which the door body 22 is opened. The mechanical unlatch operation mechanism may be configured so that the distance between the ring portion 78R of the lever 78 and the part of the rod 76 which pushes down the ring portion 78R of the lever 78 is longer than in the first and second embodiments. The mechanical unlatch operation mechanism may thus be configured so that, when the latch mechanism 30 is in the latch state and the door handle 82 is moved from the second position 82Y to the third position, the mechanical unlatch operation mechanism switches the latch mechanism 30 from the latch state to the unlatch state in conjunction with the movement of the door handle 82.

In still another modification of the second embodiment, a door handle that is disposed at a position including a position similar to that of the bottom 82B of the door handle 82 (in other words, at a position including the position at which the second end 96C of the lever 96 contacts the bottom 82B) and that is not turned but instead is advanced and withdrawn from the door body 22 may be used instead of the door handle 82. This door handle is movable between a first position and a second position as the door handle is advanced and withdrawn from the door body 22. When the door handle is in the first position, the outer surface of the door handle is flush with the outer surface 22B of the door body 22. When the door handle is in the second position, the door handle projects to the outside of the vehicle with respect to the door handle in the first position so that the operator can hold the door handle. In this case, the door handle may be configured to move to a third position, which includes a position located further to the outside of the vehicle than the second position, when it is operated from the second position in the direction in which the door body 22 is opened. Moreover, the vehicle door device may be configured so that, when the latch mechanism 30 is in the latch state and the door handle is moved from the second position to the third position, the direction of the operating force is changed, so that the rod 76 is moved down in conjunction with the movement of the door handle and the latch mechanism 30 is switched from the latch state to the unlatch state.

The above embodiments and the above modifications may be combined as appropriate.

Although examples of the disclosure are described above, it is to be understood that the disclosure is not limited to them and various modifications can be made without departing from the spirit and scope of the disclosure.

What is claimed is:

1. A vehicle door device, comprising:

a latch mechanism provided on a door body for a vehicle and configured to be switchable between a latch state and an unlatch state when the door body is in a closed state, the latch state being a state in which the latch mechanism is engaged with a striker on a vehicle body side to restrict opening of the door body and the unlatch state being a state in which the latch mechanism is disengaged with the striker so as not to restrict opening of the door body;

a door handle provided in an opening formed in the door body and configured to be movable between a first position and a second position, the first position being a position in which an outer surface of the door handle is flush with an outer surface of the door body, and the second position being a position in which at least a part of the door handle projects to outside of the vehicle with respect to the door handle in the first position so that an operator can hold the door handle;

a door handle projecting mechanism configured to move the door handle from the first position to the second position when a press portion provided on the outer surface of the door handle is pressed;

an electrical unlatch operation mechanism including a switch and an electric actuator, the switch being operated by the door handle, and the electric actuator being configured so that, when the switch is operated during a single action of pressing the press portion, the electric actuator is operated to switch the latch mechanism from the latch state to the unlatch state; and a mechanical unlatch operation mechanism selectively connected to the door handle, and configured to switch the latch mechanism from the latch state to the unlatch state in conjunction with a predetermined movement of the door handle, wherein when the latch mechanism is in the unlatch state, the door body is openable by one of the door handle or an edge of the opening formed in the door body, wherein the door handle is configured so as to move to a third position when operated from the second position in a direction in which the door body is opened, the third position including a position located further to the outside of the vehicle than the second position, and wherein the mechanical unlatch operation mechanism is configured so that, when the latch mechanism is in the latch state and the door handle is moved from the second position to the third position, the mechanical unlatch operation mechanism switches the latch mechanism from the latch state to the unlatch state in conjunction with the movement of the door handle.

2. The vehicle door device according to claim 1, wherein:

the door handle is disposed so that a longitudinal direction of the door handle extends in a horizontal direction as viewed from a front side of a door and is configured to move between the first position and the second position as the door handle is turned about an axis of a shaft extending in a vertical direction of the door;

the shaft is disposed at such a position in the longitudinal direction of the door handle that is located on one side in the longitudinal direction of the door handle as viewed from the front side of the door and that is located other than in an end in the longitudinal direction of the door handle, and the press portion is provided on an end of the outer surface of the door handle which is located on the one side in the longitudinal direction of the door handle;

the door handle projecting mechanism is configured to turn the door handle from the first position to the second position when the press portion is pressed; and the switch of the electrical unlatch operation mechanism is disposed so as to face an inner surface of an end of the door handle which is located on the one side in the longitudinal direction of the door handle.

3. The vehicle door device according to claim 1, wherein:

the door handle has a U-shape that opens upward or toward a side as viewed from a front side of a door and is configured to move between the first position and the second position as the door handle is turned about an axis of a first shaft that extends through both ends of the U-shape in a direction in which the ends face each other;

the door handle projecting mechanism includes a flap and a lever, the flap is disposed inside the U-shape of the door handle as viewed from the front side of the door, includes a base portion through which the first shaft extends, and is configured to turn about the axis of the first shaft, and the flap includes a press plate and a protruding portion, the press plate extending from the base portion toward a bottom of the U-shape of the door handle and having the press portion on an outer surface of the press plate, and the protruding portion protruding from the base portion toward an inner side of the door, the press portion is configured so that, when not being pressed, the press portion is aligned with the door handle in the first position by a biasing force of a spring, and the flap is configured so that, when the press portion is pressed, the flap is turned and the protruding portion operates the switch of the electrical unlatch operation mechanism; and the lever has a V-shape as viewed in an axial direction of the first shaft, has a first end contacting an inner surface of the press plate and a second end contacting an inner surface of the bottom of the U-shape of the door handle, and is configured to turn about an axis of a second shaft that is disposed parallel to the first shaft at a position closer to the first end than a bend is, and the lever is configured so that, when the press portion is pressed and the flap is turned accordingly, the first end of the lever is pushed by the press plate and the lever is turned accordingly, and the second end of the lever pushes the door handle toward the second position.

* * * * *